United States Patent [19]

Bucksbee

[11] Patent Number: 4,844,338

[45] Date of Patent: Jul. 4, 1989

[54] RAIL FASTENER

[75] Inventor: James H. Bucksbee, McKean, Pa.

[73] Assignee: Lord Corporation, Erie, Pa.

[21] Appl. No.: 223,700

[22] Filed: Jul. 21, 1988

Related U.S. Application Data

[63] Continuation of Ser. No. 938,921, Dec. 5, 1986, abandoned.

[51] Int. Cl.[4] ..... B61B 9/62

[52] U.S. Cl. ..... 238/283; 238/310

[58] Field of Search ..... 238/310, 283, 338, 382, 238/304, 282, 287, 264

[56] References Cited

U.S. PATENT DOCUMENTS 3,576,293 4/1971 Landis ..... 238/310 X 3,784,097 1/1974 Landis ..... 238/310

4,216,904 8/1980 Vivion ..... 238/338 X 4,561,589 12/1985 Hixson ..... 238/310 X 4,635,846 1/1987 Todd ..... 238/338 X

*Primary Examiner*—Johnny D. Cherry

*Assistant Examiner*—Joseph D. Pape

*Attorney, Agent, or Firm*—Philip P. McCann; James W. Wright

[57] ABSTRACT

A rail fastener having a rail support plate coated with electrical resistant elastomeric material to protect against electrical current leakage from the rail through the rail support plate is described. The only part of the support plate not coated with the electrical resistant elastomeric material are the serrations of the support plate. The coating of the support plate protects against current leakage from the rail to the support system.

2 Claims, 2 Drawing Sheets

RAIL FASTENER

This application is a continuation, of application Ser. No. 938,921 filed Dec. 5, 1985, now abandoned.

This invention relates to rail fasteners as used in a rapid transit rail system wherein such fasteners are used to fasten the rails to an underlying structure such as wood ties, concrete ties or concrete slabs. The invention more specifically relates to an improved rail fastener to protect against electrical current leakage of the rail to the support system and to protect the metal components of the rail and/or rail fastener from corrosion.

BACKGROUND OF THE INVENTION

Rail fasteners of the general type described above have heretofore been proposed: see e.g., German Auslegeschrift No. 1204697 and U.S. Pat. Nos. 3,576,293 and 3,784,097. The assemblies of each of the foregoing references include a base plate, a rail plate for attachment to the rail and positioned between the rail and the base plate, and an elastomeric material such as neoprene interposed between the base plate and the rail plate. The elastomeric material supports the rail plate from the base plate, damps vibration of the rail plate and electrically insulates the base plate and the rail plate and/or rail.

Because rapid transit rails are used as electrical conductors for traction power current as well as for train speed command signals, it is necessary to provide and maintain electrical insulation between the rails and the rail support structure. The aforesaid rail fasteners presently in use do provide some electrical insulation between the rails and the rail support structure. However, heretofore, the surface creepage paths provided by the insulating elements of existing apparatus were found to be relatively short and easily contaminated with dirt and wheel and rail wear products. When these contaminated surfaces then became wet by fog, rain, or ground water, electrically conductive paths are formed over which electrical leakage currents flowed. Such leakage currents caused corrosion of the rail as well as of the metal parts of the rail fasteners and supports, resulting in further contamination of the surface creepage paths. This additional contamination of the creepage paths results in further reduction of the electrical resistance of the creepage paths and thence results in larger magnitudes of leakage currents.

Such excessive leakage currents from train operation over poorly insulated rails caused destructive corrosion of rail, rail fasteners, rail support structures, metal tunnel liners, concrete reinforcement bar and other metallic structures. An excessively low rail to rail support structure electrical resistance caused by such corrosion also tended to short out train speed command signals between the rails. In such a situation, the shorted section of track then appears to the train speed command system as though it were occupied by a train, and for safety reasons train operation is disrupted. Such an occurence is generally referred to in the art as a "ghost train".

To prevent loss of electrical train speed command signals and leakage of electrical traction currents over potential creepage paths, rail circuit insulation integrity must be maintained, and the rail fastener or support insulation must provide electrical insulation even when wet and contaminated with electrolyte. Therefore, the rail must be insulated from the supporting structure and/or portions of the rail fastener with electrical insulation means which provides relatively high electrical resistive surface creepage paths. Such high electrical resistive creepage paths will maximize the electrical leakage path resistance between rail and rail support even when the rail and the rail fastener or support apparatus are wet and/or contaminated with electrolyte.

In addition, the rail support insulating device must not interfere with the rail fastener's ability to securely fasten the rail relative to the support structure and to limit relative movement of the rail to within acceptable tolerances in the vertical, lateral, roll and longitudinal directions.

One form of rail support insulating device to prevent the above decribed current leakage is disclosed in U.S. Pat. No. 4,615,484 which included an electrically nonconductive skirt member surrounding and extending outward from the rail fastener and over it support structure and a pair of planar disc members of electrically nonconductive material adjacent the bolt heads. Such a device adds extra components to a rail fastener to overcome the problem of current leakage. It is desirous to have a rail fastener that overcomes the problem of current leakage by incorporating additional electrical protection into the rail fastener.

SUMMARY OF THE INVENTION

It is an object of the present invention to provide an improved rail fastener that overcomes the problem of current leakage by incorporating current leakage protection into the rail fastener.

It is another object of the present invention to provide an improved rail fastener having a rail plate coated with an elastomer material that acts as a barrier against current leakage from the rail to the supporting structure and/or portions of the rail fastener. Furthermore, the elastomeric material provides corrosion protection to the entire rail fastener and between the rail and rail fastener.

The rail fastener for fastening a rail to an underlying support structure of a rapid transit rail system comprises (1) a rigid rail support plate to which a rail is attached; (2) means to secure said rail to said rigid rail metal support plate such that said rail will overlie said support plate in a predetermined area of said plate; (3) a means for securing said rail support plate to said support structure; (4) a resilient elastomeric material interposed between said support plate and said support structure wherein said resilient elastomeric material allows for vertical and lateral movement of said upper plate relative to said lower plate and provides electrical insulation within said rail fastener; and (5) an electrically resistant elastomeric material covering said support plate to prevent leakage of current from said rail and said support structure.

DESCRIPTION OF THE DRAWINGS

Other features of the invention will be apparent from the following description of illustrative embodiments thereof, which should be read in conjunction with the accompanying drawings, in which.

DESCRIPTION OF THE PREFERRED EMBODIMENTS

Figure 1:
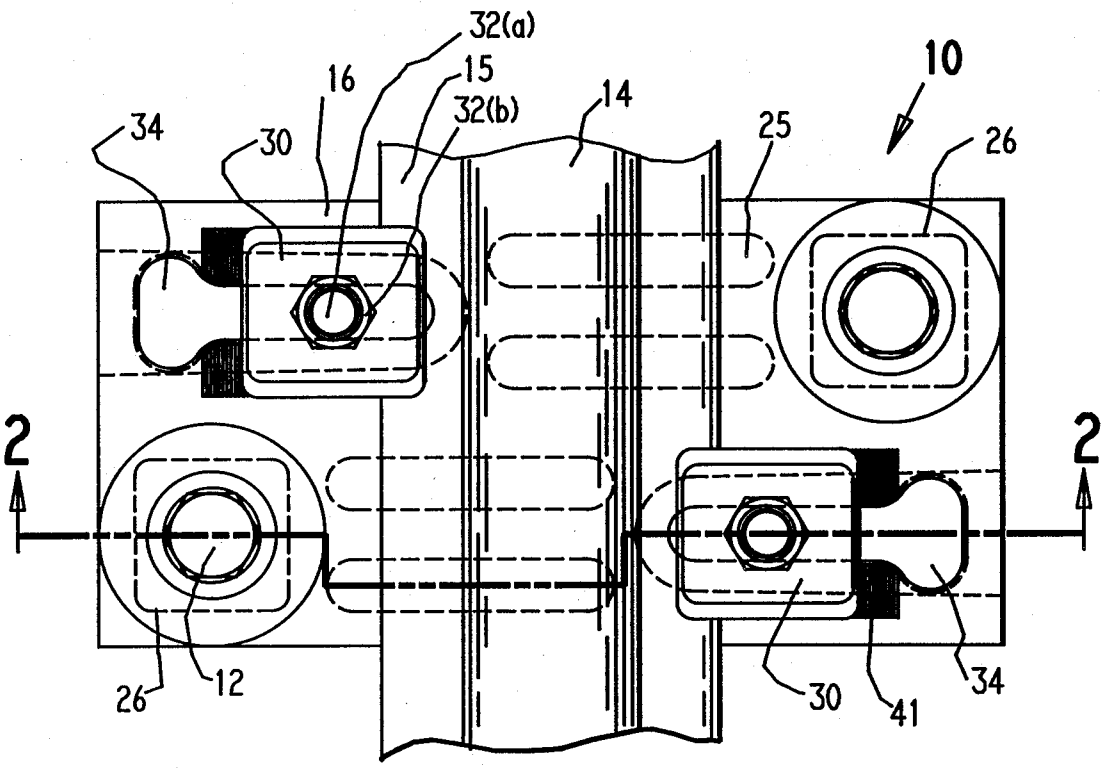
FIG. 1 is a top plan view of a rail fastener assembly in accordance with the invention.
Figure 2:
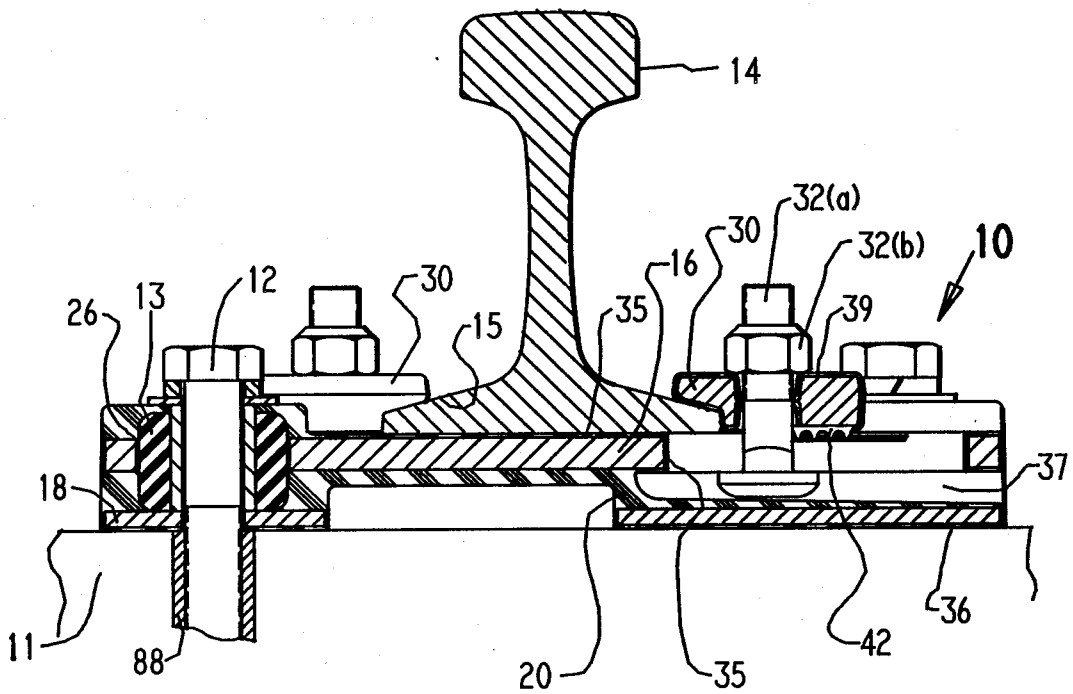
FIG. 2 is a vertical section taken approximately along the line 2—2 of FIG. 1.

With reference to the drawings, FIG. 1 and FIG. 2 show a typical rail fastener 10 as it appears when installed for directly affixing a rail 14 to a support structure 11. The rail fastener 10 has a rail support plate 16 and means to secure the rail to the support plate which in the present embodiment is a pair of clips 30 wherein the pair of clips 30 and support plate 16 are coated with electrically resistant elastomeric material 39, 35 according to the present invention. Although the electrically resistent elastomeric material coating the clips and support plate may be used on different rail fasteners, for purposes of illustration, it is shown as used on a rail fastener similar to that described in U S. Pat. No. 3,576,293.

The rail fastener 10 further includes a lower plate 18, which is also coated with electrically resistant elastomeric material 36, which is interconnected to the support plate 16 by resilient elastomeric material 20. The rail 14 is mounted in place on the rail support plate 16 and held in place by the clips 30.

The support plate 16 generally has a lateral width of approximately 14.5 inches and a longitudinal extent, parallel to the direction of the rail 14 of about 7.5 inches and a thickness of about ½ inch, having openings 26 at two of its diagonally opposite corner areas for reception of the anchor bolts 12. Located on the upper surface of the support plate 16 is a series of serrations 41 extending in a direction parallel to the direction of the rail 14. However, in some applications it is known that the directio of the serration may be at an angle to the direction of the rail.

The layer of resilient elastomeric material 20 is interposed between the support plate 16 and the lower plate 18 to provide vibrational damping for the support plate 16 and to electrically isolate the support plate 16 from the support structure 11. In a typical rail fastener, the resilient elastomeric material 20 has a thickness of about 0.75 inches.

A plurality of laterally directed elongated voids 25 are provided in the resilient elastomeric material 20 (see FIG. 1) in the central region generally underlying the rail 14. The voids 25 are spaced apart along the direction of the rail 14 by approximately 1 inch between center lines.

The rail support plate is adapted to be fixedly secured to a support structure 11, such as a wood tie, concrete tie or concrete slab, by means such as suitable anchor bolts 12. The bolts 12 pass through openings 26 in the plates 16 and 18 to threadably mate with a metallic insert 88 anchored in the support structure 11. A pair of plastic inserts 13 surround the anchor bolts 12. The inserts are disposed coaxially of the anchor bolts 12 through plate 16 in the opening 26.

The pair of clips 30 are each attached by a bolt **32*a* and a nut 32*b* to the support plate 16 and serve to secure the lower flanges 15 of the rail 14 to the support plate 16. The lower end of the bolt extends below the support plate 16 through a T slot 34 therein and into an aligned, enlarged cavity 37 formed within the resilient elastomeric layer 20. The T slot 34 allows the clip 30 to be moved and adjusted into engagement with the rail flange 15 before the bolt 32*a* and nut 32*b* are tightened. Located on each clip 30 is a set of teeth 42 which matches the serrations 41 of the upper plate 16** to facilitate locking of the clip in place as described above.

The rigid rail support plate 16 and the lower plate 18 of the rail fastener 10 are covered with a coating of electrically resistant elastomeric material 35 bonded by vulcanization to said support plate 16 and said lower plate 18 to cover any exposed metal part except for the set of serrations 41. The electrically resistant elastomeric material 35, 36 is a composition of natural rubber, or a mixture of natural rubber and styrene butadiene, or neoprene. The rail fastener assemby, excluding the clips, is assembled in an upside down fashion in a mold in the following steps:

(1) position a suitably calendered electrically resistant elastomeric material, which will cover the top upper plate, on the bottom of the mold;
(2) position the rail support plate 16 onto the calendered electrically resistant elastomeric material such that pins of the mold correspond to openings 26 of the support plate 16;
(3) position the plastic inserts 13 over the pins into the support plate 16;
(4) position the lower plate 18 such that the pins allign the lower plate 18 with the support plate 16; and
(5) position a suitable calendered electrically resistant elastomeric matrial which will cover the bottom of the lower plate, on top of the assembled components.

Thereafter, the mold is closed, and the resilient elastomeric material 20 is injected intermediate of said support plate 16 and said lower plate 18. The elastomeric material is then vulcanized at a temperature from 300° to about 340° F. at a pressure from about 2000 to about 3000 psi for a time from about 15 to about 20 minutes depending on the elatomeric material and desired properties.

The clips 30 are coated with the electrically resistant elastomeric material 39 by a dipping or coating process to cover exposed metal parts except for the teeth 42. The elastomer coating for the clip may or may not be the same composition as the elastomer used on the support plate 16. One suitable coating is CHEMGLAZE® M331 elastomeric polyurethane coating which is commercially available from Lord Corporation. The electrically resistant elastomeric material 35, 36 may be the same elastomeric material as the resilient elastomeric material 20. The thickness of the coating of elastomeric material on the clips 30 and support plate 16 is about 0.0625 inch.

When the clips and upper plate of the rail fastener have been coated with elastomeric material, the flow of leakage current through the fastener is greatly reduced or essentially entirely limited.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teaching of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A rail fastener for fastening a rail to a support structure comprising:

(a) a rigid rail support plate having a set of serrations;

(b) a clip means to secure said rail to said support plate having a set of teeth wherein said set of serrations and teeth interlock when said clip is positioned such that said rail will overlie said rail support plate in a predetermined area of said plate;

(c) a means for securing said rigid rail support plate to said support structure;

(d) a resilient elastomeric material disposed intermediate of said support plate and said support structure wherein said resilient elastomeric material allows for vertical and lateral movement of said support plate relative to said support structure and provides electrical insulation within said rail fastener;

(e) a lower plate disposed between said resilient elastomeric material and said support structure; and (f) a coating of an electrically resistant elastomeric material separately totally encapsulating and being bonded to each of the following components: said rigid rail support plate except for said set of serrations; said clips means except for its teeth; said lower plate; and means for securing said rigid rail support plate to said support structure.

2. A rail fastener according to claims 1 wherein said resilient elastomeric material and said electrically resistant elastomeric material are the same.

* * * * *